US008926892B2

(12) United States Patent
Eckert

(10) Patent No.: US 8,926,892 B2
(45) Date of Patent: Jan. 6, 2015

(54) RECUPERATED ISOTHERMAL MELTER AND RELATED METHODS

(76) Inventor: C. Edward Eckert, New Kensington, PA (US)

( * ) Notice: Subject to any disclaimer, the term of this patent is extended or adjusted under 35 U.S.C. 154(b) by 66 days.

(21) Appl. No.: 13/447,203

(22) Filed: Apr. 14, 2012

(65) Prior Publication Data

US 2013/0269482 A1 Oct. 17, 2013

(51) Int. Cl.
*F27B 19/02* (2006.01)

(52) U.S. Cl.
CPC ..... *F27B 19/02* (2013.01)
USPC ..... 266/90; 266/242; 432/156

(58) Field of Classification Search
USPC ..... 266/242, 90; 432/156
See application file for complete search history.

(56) References Cited

U.S. PATENT DOCUMENTS 1,904,684 A * 4/1933 Greene ..... 75/10.66
5,378,261 A * 1/1995 Aizatulov et al. ..... 75/528
5,925,165 A * 7/1999 Pflugl et al. ..... 75/10.41
2005/0189346 A1 * 9/2005 Eckert ..... 219/548

FOREIGN PATENT DOCUMENTS

CN 201269692 Y * 7/2009

OTHER PUBLICATIONS

Derwent Acc-No. 2009-L77250 for the patent family including CN 201269692Y by Liu, R published Jul. 8, 2009. Abstract.*

* cited by examiner

*Primary Examiner* — George Wyszomierski
*Assistant Examiner* — Tima M McGuthry Banks
(74) *Attorney, Agent, or Firm* — Gary P. Topolosky

(57) ABSTRACT

An energy efficient metal melter has a portion of melting energy supplied to it by a combustion process for heating a melter charge to a temperature where the melter charge can no longer maintain its shape. A portion of melting energy is also supplied by an electrical process for adding remaining transformational and sensible heat. The combustion process preferably uses a hydrocarbon fuel energy source selected from a distillate compound, gas compound or both and the electrical energy comes from a source selected from an external power grid, a generator and combinations thereof.

11 Claims, 18 Drawing Sheets

- 250 kW - 15mW
- DoD SURPLUS TURBINES
- DoD SURPLUS PARTS
- TURBINE < $1/WATT
- PORTABLE
- MOST EFFICIENT MELTING
- LOWEST CARBON FOOTPRINT
- DISTRIBUTED POWER
- FAVORABLE VOLT PR

RECUPERATED ISOTHERMAL MELTER AND RELATED METHODS

This invention addresses novel equipment (i.e., a melter) and related methods for melting materials, notably metals, and more specifically aluminum with that equipment. The method may use both fossil fuels and electricity as energy sources. Fossil fuels may be used to heat the material to be melted (charge) to the point where actual melting occurs (melting point for a pure metal, solidus for a metal alloy, and softening point for a non-metal). The charge is further heated by electric means once incipient melting is accomplished. It is possible to heat and completely melt the charge by electric means alone at a sacrifice in thermal efficiency and melt rate. Conversely, fossil fuels cannot be used without a minimum level of electricity.

This melter consists of two chambers or zones. The first zone is essentially a shaft that accepts solid charge and contains it within walls. Heated air from a combustion process is introduced into the bottom of the shaft and flows counter-current to the bulk movement of the charge. The air temperature is typically above a "target" temperature, i.e., the melting point for a pure material, solidus for an alloy, or softening point for a non-metal. A suitable means of support, such as a grate, suspends the solid charge above a second chamber that consists primarily of a flowing stream of molten metal.

Melter operation at an optimum fossil to electrical energy ratio sources will maximize thermal efficiency and throughput; however, this ratio can be adjusted contingent on prevailing energy cost. Advantages of this melter are operation at near theoretical energy efficiency, maintenance of thermal efficiency over a throughput range, very small size and footprint, reduced emissions, exceptional molten metal quality, and modularity. The latter provides flexibility to adapt the basic melter design based on the type of charge used.

General ITM Information

The Isothermal Melting (ITM®) Process is an advanced high performance aluminum melting process. It was developed to melt aluminum with dramatically reduced energy consumption and melt loss, produce no in-plant emissions, and use reduced floor space. The process operates at a specific melting energy requirement of 552 BTU/lb Al (industry average: more than 1800 BTU/lb Al), melt loss less than 1% (industry average: 2-3%), and requires one-third the floor space of a conventional aluminum melter.

ITM® is differentiated from all other commercial melting processes by the following main aspects:

- its method of energy conversion to produce heat; and
- its means for transferring thermal energy into the melt (or charge).

The ITM® process uses electrical energy. In the context of ITM®, electrical to thermal energy conversion occurs by electrical resistance. The very distinctive advantage of this heating method is that the conversion process occurs at essentially 100% energetic efficiency. Electric resistance energy conversion is not unique to the ITM® process, however. Some aluminum melters employ roof mounted radiant heating devices (known as "Glow Bars"), while other low throughput melters use resistance heaters in combination with silicon carbide crucibles. Both of these heating methods rely on radiation heat transfer with substantial efficiency and performance penalties.

Resistance heating in aluminum processing is primarily restricted to holding applications where heat flux is not a significant factor. High-rate and thermally efficient electrical resistance melting have not been accomplished in the aluminum industry prior to the emergence of ITM®.

Other electrical heating methods used for aluminum melting include: induction, plasma, and arc. All of these methods are limited either by comparatively low conversion efficiency or reduced heat flux. Induction heating, for example, is capable of converting less than 70% of the theoretical thermal energy equivalent in electricity due to complex power supplies and externally cooled inductors.

Two key enabling heating technologies comprise the ITM® process: (1) a robust, moderate heat flux panel based heating system (known as BSPP). It provides holding heat. Also, (2) a very high heat flux direct immersion heater (DI) that is used to satisfy the melting heat requirements in an array geometry. Both of these heating technologies were specifically developed for the ITM® process.

Isothermal Melting embodies an array of direct immersion resistance heaters in a heating bay operating at a heater specific heat flux as high as 150 w/in$^2$. Heat transfer from the heater surface is predominantly by forced convection to a flowing metal stream, and ultimately sinking this heat by a continuous melter charge feed. The effective melt surface heat flux in the array is at least 385,000 BTU/hr-ft$^2$, and heater surface to bulk metal temperature difference is approximately 71° F.

Sink side heat transfer to the charge is also by predominantly forced convection, and the maximum bulk to charge temperature differential is 34° F. Obviously, low loss heat transfer is germane to the successful operation of an Isothermal Melter.

Conventional melting furnaces are frequently designed to operate in a thermally cycled batch-processing mode. Such operation is discontinuous, and therefore less efficient by nature. Isothermal Melting, however, imparts heat as a continuous process. Accompanying FIG. 1 is a schematic representation of an Isothermal Melter with the BSPP and DI heat sources identified therein. The particular sequence of unit operations (pump-charge-treat-heat) was selected for design expedience.

A straightforward heat balance can be used to illustrate ITM® operations. Equation (1) is essentially an elementary energy balance that describes the conditions necessary for "isothermal" operation:

$$W_R/W_C=(\Delta T_C+\Delta H_m/Cp)/\Delta T_R \quad (1)$$

Here, $W_R$, $W_C$=recirculating metal flow rate and charge rate, $\Delta T_R$=recirculating temperature differential (source-sink), $\Delta T_C$=charge temperature differential, $\Delta H_M$=heat of melting, and Cp is heat capacity with the simplifying assumption that it is constant over the temperature range of interest and equal in both solid and liquid states.

It can be shown for melting room temperature aluminum using a $\Delta T_R$ of 34° F., the recirculating rate to charge rate is approximately 55:1. A charge rate of 5,000 lb/hr therefore requires a recirculation rate of 275,000 lb/hr, which is reasonable. An Isothermal Melter containing 8,500 pounds of internal metal would therefore experience a complete turnover approximately every 2 minutes. In some instances, the static (holding metal) capacity of an Isothermal Melter is determined more by charge media form considerations than thermal considerations.

FIG. 2 illustrates the energy balance (from above Equation 1) in a more pictorial form. Only melting heat is considered in the illustration, and in the context of this energy balance, the box can be considered pseudo-adiabatic due to the influx of heat from the separate BSPP heating system.

One of the most significant differences between conventional melters and ITM® is the heat transfer mode. Radiation is the dominant primary source-to-sink heat transfer mode in most conventional melters. Virtually all-conventional reverberatory aluminum melters use radiation heat transfer either from a gas flame. Far less common are melters based on the use of glow bars. However, radiation remains the dominant mode of heat transfer therefor.

FIG. 3 illustrates radiation based heat transfer from an overhead flame, and the heat transfer and efficiency limitations inherent with gas burner based melting. All values are based on melting aluminum at a 60-lb/hr-ft$^2$ rate, using typical gas fired melter efficiencies. A natural gas flame requires a significant amount of combustion air that reduces the cycle efficiency of the melter. The enthalpy loss reflected by a 183 lbs stream of products of combustion (POC) at 2000° F.+ is considerable, since it includes approximately 17.5-volume percent water in the form of vapor. Such water represents a substantial thermal loss in the form of latent heat of vaporization. In this example, a total heat loss in excess of 190,000 BTU/hr would result from a gross heat input equivalent of 275,000 BTU/hr. This is necessary to deliver a net melt surface heat flux of almost 27,000 BTU/hr-ft$^2$ that is required to support an aluminum melt rate of 60 lb/hr.

A high melt surface temperature also occurs via the preceding heating method. That temperature, combined with oxygen, results in an accelerated oxidation. Melt loss notwithstanding, the resulting oxide formation further impedes heat transfer and increases melt surface temperature. A net heat flux of approximately 27,000 BTU/hr-ft$^2$ is used in most commercial furnace designs to avoid excess melt surface temperature and optimize thermal efficiency.

BRIEF DESCRIPTION OF THE FIGURES

Further features, objectives and advantages of the present invention will become clearer when referring to the following detailed description made with reference to the accompanying figures in which:

FIG. 17 is a top perspective view of one embodiment incorporating ITM® in a stack-like arrangement; showing more of.

ADDITIONAL BACKGROUND

Figure 1:
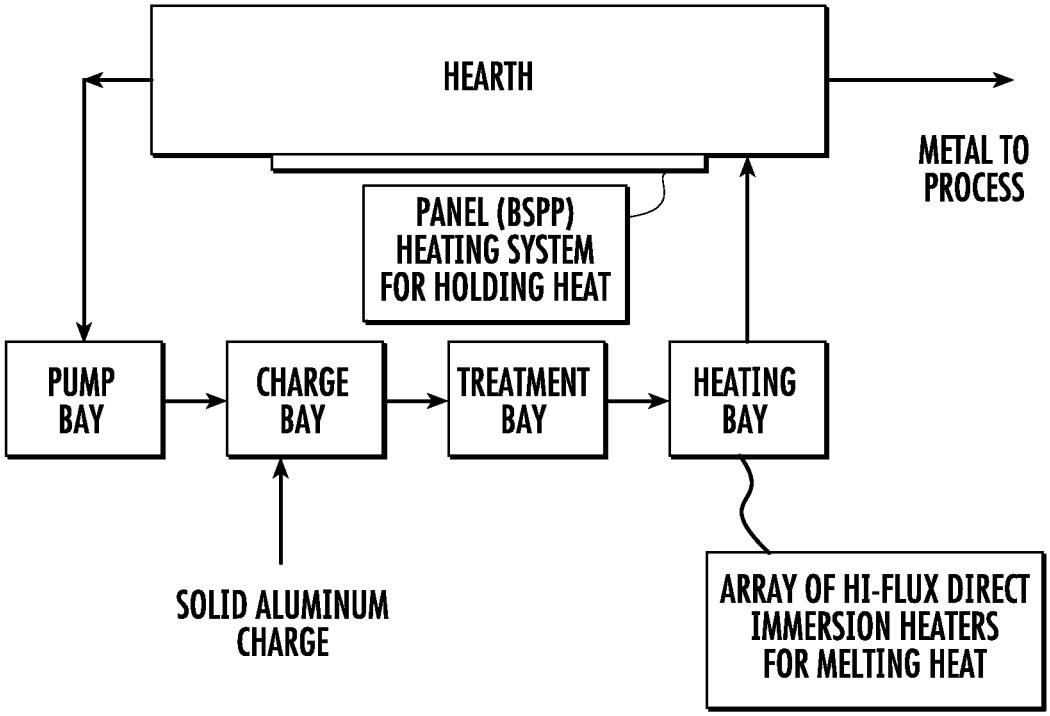
FIG. 1 is a schematic representation of Isothermal Melting Process with its BSPP and DI heat sources identified therein.
Figure 2:
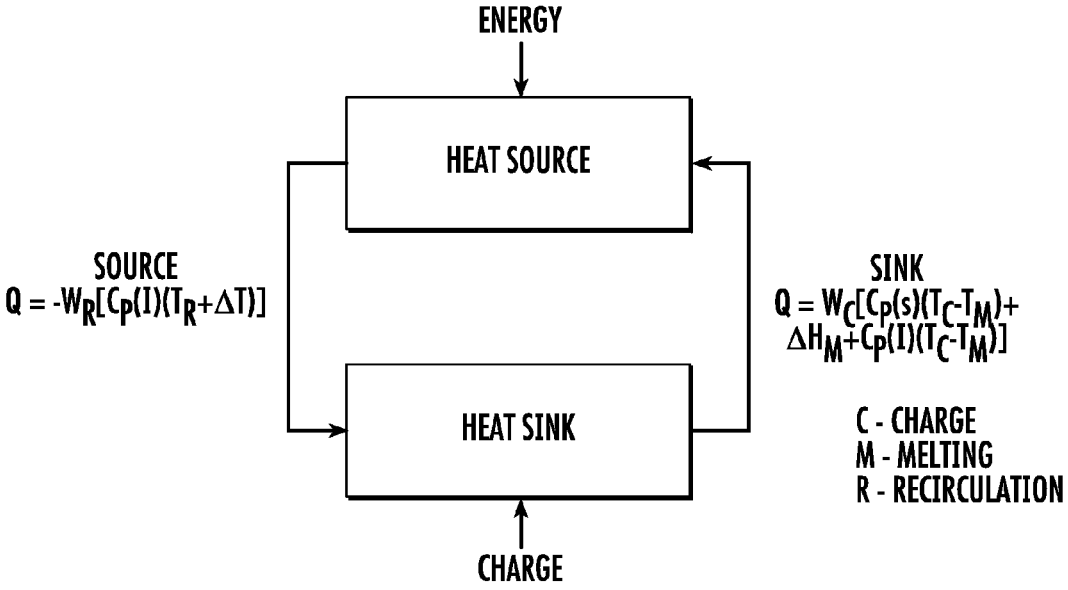
FIG. 2 is a schematic representation of the energy balance in an Isothermal Melting Process that uses electrical energy to provide melting heat and depends on convective heat transfer to impart same to an incoming charge.
Figure 3:
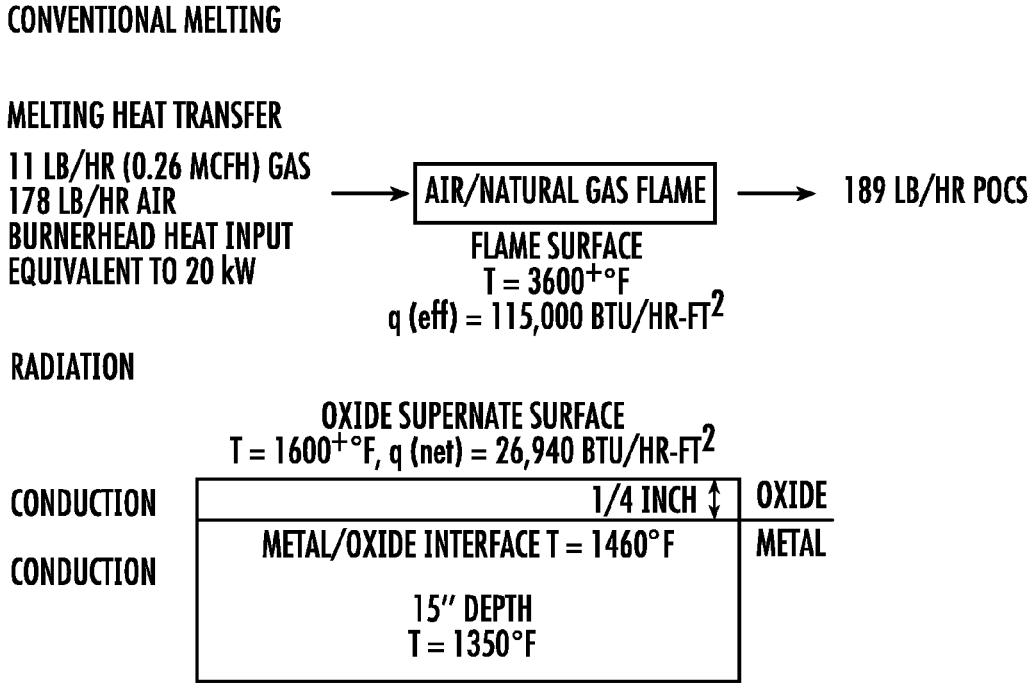
FIG. 3 is a schematic representation of radiation-based heat transfer from an overhead flame, and the heat transfer/efficiency limitations inherent with gas burner based melting.

Related art to this invention involves a melting device known as a "stack melter". But stack melters are exclusively heated by combustion burners and most typically fueled by natural gas. They are two chamber devices with the first chamber, or stack, receiving the solid charge to be melted and the second chamber receiving the semi-plastic or partially melted charge to complete the melting process.

A natural gas burner typically supplies heat in the form of high temperature combustion products to the bottom of the stack, with flow counter current to the movement of charge through the stack. The high surface area of the solid charge provides for favorable heat transfer conditions. Accordingly, the charge is typically heated to a state where it begins to flow and pass out of the stack and into the second chamber. The second chamber is heated by a burner with products of combustion passing into the stack to augment heating of the charge. This burner also provides heat to offset thermal/containment losses from the melter. In this sense, the second chamber of a stack melter is similar to a conventional burner-fired gas melter. A stack melter can therefore be characterized as a conventional gas fired melter with a charge preheating stack and regeneration through this charger preheat.

Although heat transfer is favorable in the first chamber or stack portion of the melter, conditions in the second chamber are not. The metal bath has a planar interface and therefore limited surface area for heat transfer. These "bath flat" conditions depend entirely on heat transfer dominated by radiation from the burner flame and surrounding refractory walls. The same inefficiencies inherent in conventional gas melters are present here. Surface heat transfer is typically limited to approximately 115,000 BTU/hr-ft$^2$, and the thermal efficiency in this part of the melter is generally less than 30%. Typically, the amount of metal contained in the second chamber of the stack meter is 5× to 10× the melt rate in lb/hr (i.e.: a 4,500 lb/hr melt rate would require a 22,500-45,000 lb bath).

Preferred Embodiments and General Operation

This melter has two chambers. The first chamber is a shaft that accepts solid charge. A fossil fuel burner produces hot gases that are introduced into the bottom of the shaft. These gases pass counter current to the charge direction and impart heat to the charge. Diluent air may be used to lower the temperature of these gases and avoid excess oxidation of the charge. A grate or other suitable means supports the charge in the shaft until the charge becomes semi-plastic ("mushy") and no longer can be supported by the grate. Since the charge is heated by a counter current flow of combustion products with or without diluent air, the process is regenerative.

The second chamber consists of a liquid bath of melted charge below the first chamber. Preferably, the liquid bath is circulating within this chamber to improve heat transfer. This second chamber receives semi plastic charge that drops down from the shaft or first chamber.

Figure 4:
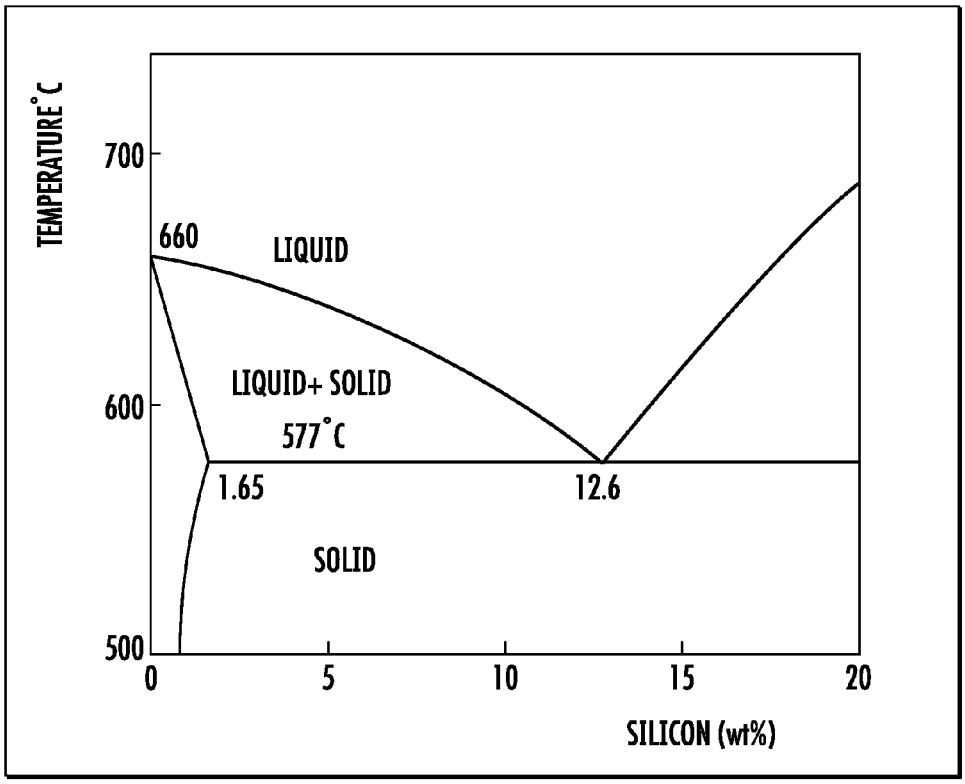
FIG. 4 is a graph depicting melting energy apportionment for this melter using a 356 alloy (Al-7% Si) charge.

Additional heat is imparted in the second chamber at high flux to complete the melting process and add sufficient superheat to provide the desired melt discharge temperature. Direct Immersion (DI) electric heaters are preferred for this purpose. The graph at FIG. 4 depicts melting energy apportionment for this melter using a 356 alloy (Al-7% Si) charge. Although commercial 356 alloy typically contains a nominal Mg concentration of 0.35%, the aluminum silicon phase diagram will be used to illustrate the fraction liquid at various temperatures. The aluminum rich side of a simplified Al—Si binary phase diagram appears in FIG. 4. The eutectic composition depicted in that diagram occurs at 12.6% Si and the eutectic reaction isotherm temperature is 570° C. (1071° F.). At that temperature, the maximum solubility of Si in α-Al at the left hand terminal solid solution is 1.65%. It can be seen through an application of the binary lever rule that the eutectic phase represents 48% of an Al-7% Si alloy at 1071° F. by:

An Al-7% Si alloy theoretically requires 511 BTU/lb to melt. Charge material at room temperature (70° F.) is continuously introduced into the top of the first chamber or shaft. Hot air from the first chamber burner begins to preheat this charge.

Figure 5:
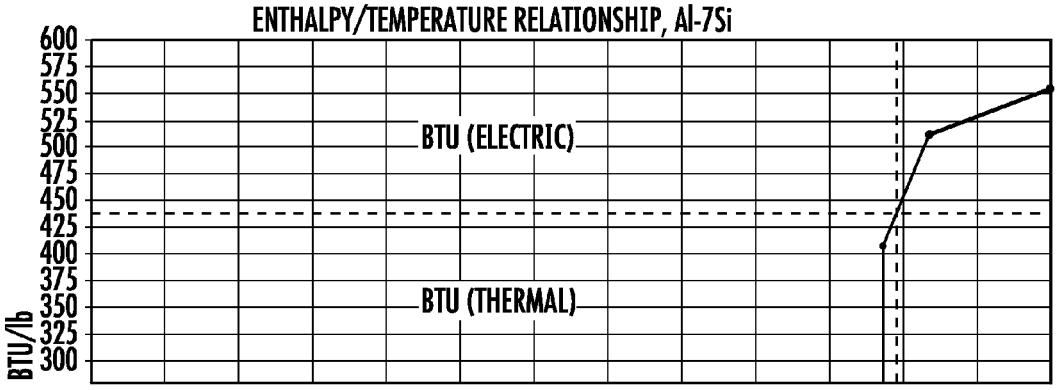
FIG. 5 is a graph depicting the enthalpy/temperature relationship for an aluminum alloy containing 7% silicon showing its solidus at 1071° F.

The total heat ($Q_t$) required to melt the solid charge of mass (M) presented to the melter is the sum of the sensible and transformation heats. The following simple equation applies:

Where: Σ=sum of sensible heats for solid and liquid $C_p$=solid and liquid heat capacities, as appropriate T=temperature, and $\Delta H_m$=transformation heat (heat of melting The temperature in the shaft progressively increases toward the bottom since the hot air flows counter-current to charge movement. Charge temperature increases accordingly. The charge will remain in the shaft until it the solidus temperature is reached and the material becomes mushy. For this alloy, the solidus corresponds to the eutectic reaction isotherm temperature of 1071° F. (See, FIG. 5). The total quantity of heat theoretically adsorbed by the charge to this temperature is 260 BTU/lb. All of this heat is sensible and only a function of the charge heat capacity and mass. Hence, it will therefore only increase the temperature of the charge. At 1071° F., the charge will begin adsorbing transformation heat isothermally as the eutectic micro-constituent melts. The eutectic phase comprises 48% of the microstructure and will adsorb an additional 146 BTU/lb until it melts and the charge becomes mushy. Once this mushy condition is achieved, the charge is no longer supportable by the grate at the bottom of the shaft, and the charge falls (drips) into the molten metal bath in the second chamber situated below the shaft. A total of 406 BTU/lb has been absorbed by the charge at this station in the melter. Essentially all of this heat has been supplied by the countercurrent hot air flow entering the bottom of the shaft. Once the mushy charge leaves the shaft or first chamber, no additional opportunity exists for direct heat transfer from the countercurrent hot air flow.

The description and operation of the melter to this point is somewhat similar to a conventional stack melter with the exception that such melters typically use high temperature (>2000° F.) air directly from a burner or from direct flame impingement. These practices result in oxidation of the charge and can limit the gage of charge melted. In the case of this invention, the combustion temperature is reduced by air dilution to approximately 1200° F., while increased forced convection is used to enhance air to charge heat transfer.

Conventional stack melters do not actively control the temperature at which the solid charge enters the bath with the consequence of lost opportunity to add maximum transformation heat and greatest thermal efficiency.

In conventional stack melters, heat supplied the molten metal bath in the second chamber is also derived from a combustion-burner system. Since the bath surface is planar and lacks topographical surface area, a large bath area exposure is required for effective heat transfer. This requirement necessitates a high quantity of contained metal which significantly increases melter size and associated heat losses.

After the mushy charge enters the bath, an additional 105 BTU/lb is added by the molten metal to completely melt the charge and therefore raise its temperature to the liquidus temperature of 1135° F. in this example. Heat transfer is partially isothermal as an additional 52% of the charge consisting largely of primary (α) aluminum, melts. Metal is to be withdrawn from that melter at a temperature of 1300° F. As such, an additional 43 BTU/lb of superheat is required as sensible heat.

The total quantity of heat supplied is 554 BTU/lb with 73% of that heat provided by the first chamber and 27% by the second chamber. In contrast to second chamber heat being derived from a combustion process in conventional stack melters, this invention uses an electric resistance heat source immersed in the molten bath. This heat source uses thermal conduction as the dominant heat transfer mechanism to impart heat to the melt and forced convection to transfer heat throughout the melt.

Since the heat source(s) is/are immersed, heat transfer occurs in the absence of air and is volumetric, i.e.: independent of melt surface area.

In this invention, conditions that determine when the mushy charge enters the liquid bath are influenced by both design parameters and operating parameters. One embodiment of the invention supports the charge using refractory posts that project up from the melt below the preheat chamber. A quantity of solid charge (charge column) is maintained in the preheat chamber and imposes a load over portions of the charge that bridge the refractory posts. This creates a 3-point loading condition where the reaction forces are provided by the posts, and the weight of the charge applies a load to the portion of the charge spanning between the posts. Based on the range of alloys to be melted, the spacing between the posts determines the magnitude of the applied bending stress. The particular charge form for this example can be approximated with cylinders since the charge consists of gate and sprue (revert). Accordingly, the section modulus and moment of inertia corresponding to cylinders are used in design. The point at which the charge column can no longer be supported by the span between the posts is determined by the maximum local bending stress and rupture strength of the material being melted. Rupture strength is determined by the material properties at the local temperature.

A series of experiments were conducted with 319 alloy (nominally 6% Si, 3.5% Cu, balance Al) to determine rupture strength between the solidus and liquidus temperatures, i.e., 960° and 1120° F., respectively. These experiments subjected a 0.5 inch diameter solid cylinder to 3-point loading over a 2.0 inch span at several temperatures. Each data point represents the stress at failure, as determined by textbook relationships between applied load maximum bending moment, and the moment of inertia for a solid cylinder.

Figure 6:
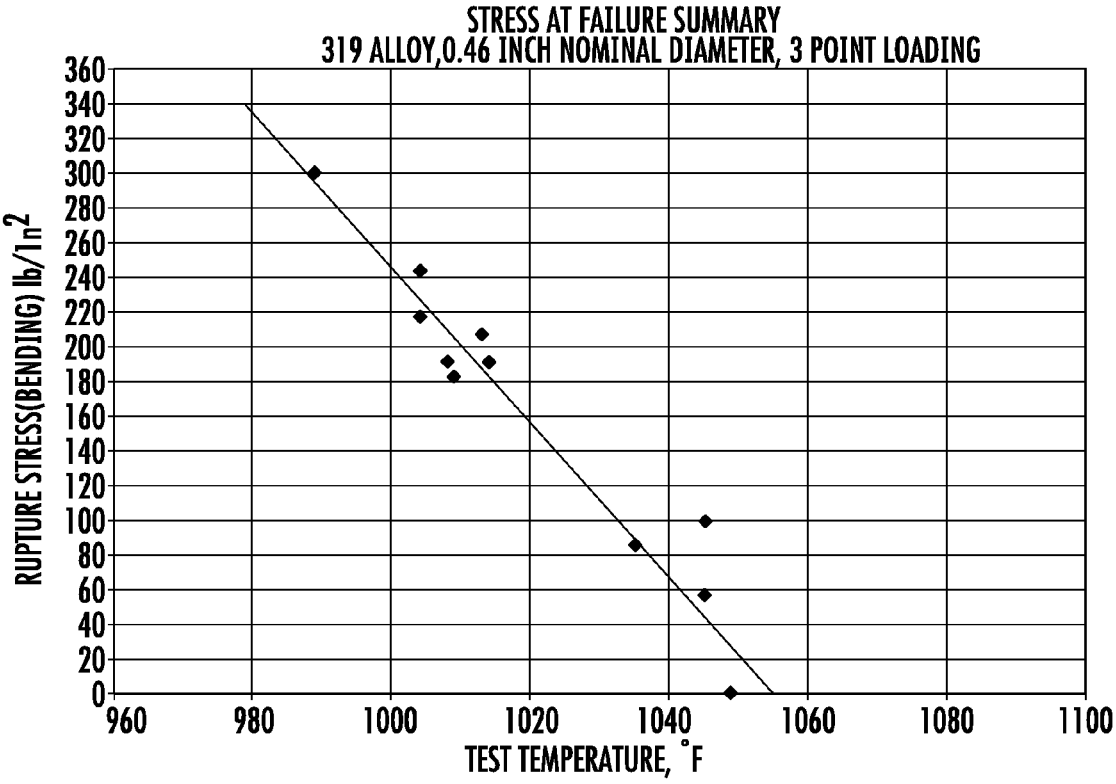
FIG. 6 is a graph depicting stress at failure for 319 aluminum at varying test temperatures.
Figure 7:
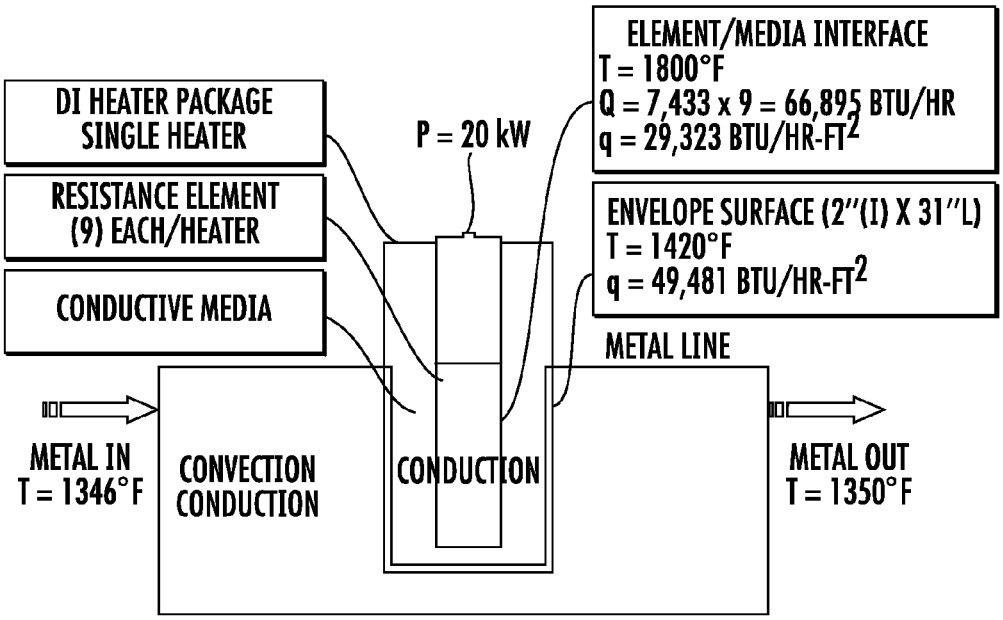
FIG. 7 is a schematic representation of primary heat transfer from a cylindrical geometry source to a flowing metal stream.
Figure 8:
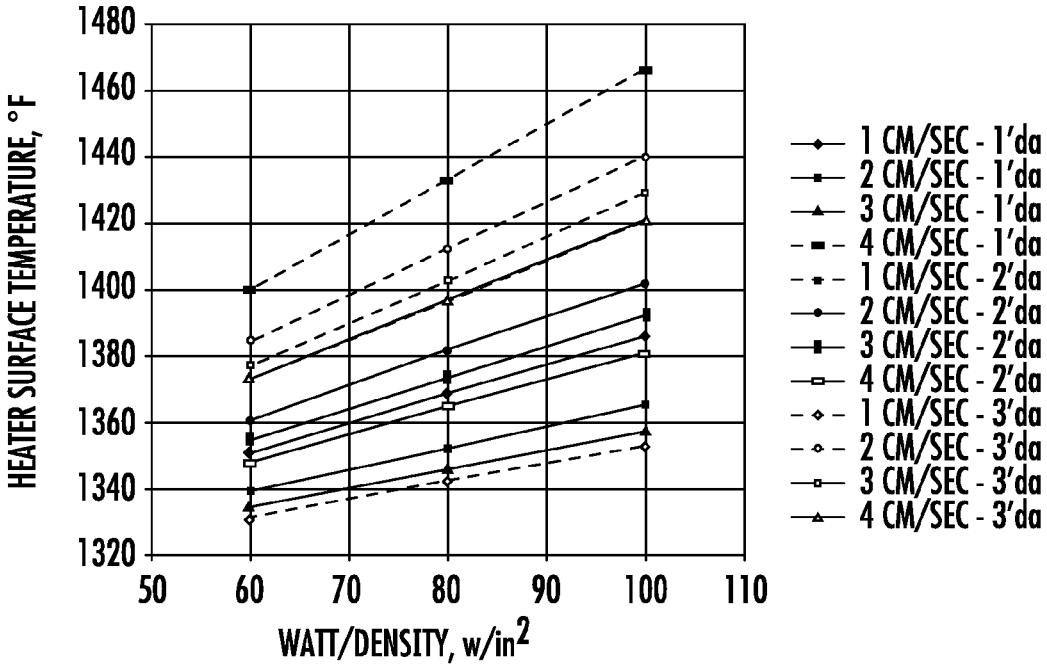
FIG. 8 is a graph depicting primary melting heat transfer from (3) heat source cylindrical sources to a flowing metal stream.
Figure 9:
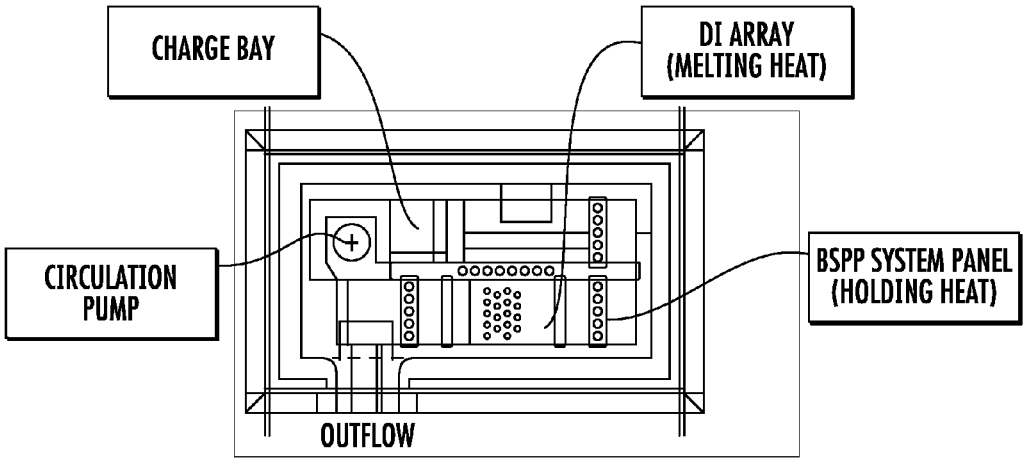
FIG. 9 is a schematic representation of one embodiment of Isothermal Melter.
Figure 10:
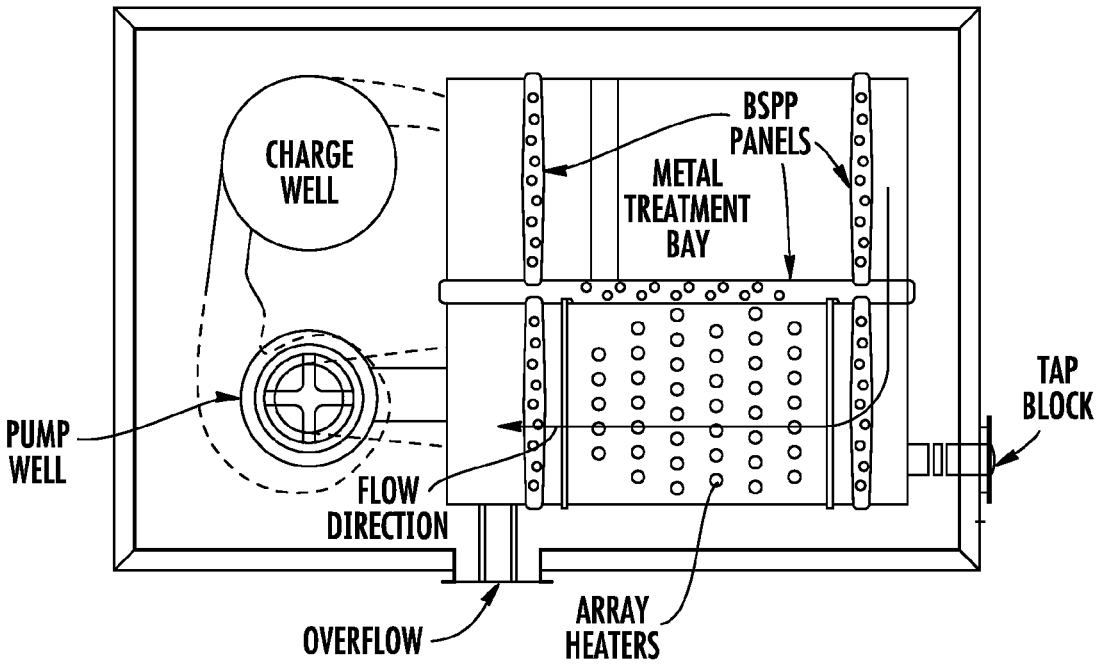
FIG. 10 is a schematic representation of a commercial Isothermal Melter designed for a nominal charge rate of 5,000 lb/hr and expanded by 40%.

It can be seen from the summary graph at FIG. 6 that 319 alloy will rupture at an arbitrary 100 lb/in$^2$ load and 1035° F. Since the delivered exhaust air temperature from the turbine to the charge preheat chamber is almost 1100° F., designing the charge column support post spacing to impart a 100 lb/in$^2$ stress magnitude is reasonable as a design parameter.

Minor alloy chemistry variations, ambient temperature variability, and changing loading conditions on the turbine will impact on preheat chamber air temperature. A means is therefore provided to introduce dilution air for the purpose of manipulating local charge temperature to optimize the drop in point to the liquid bath. Preferably, non-contacting optical pyrometry is used to measure charge temperature, but conventional thermocouples imbedded in the charge preheat chamber wall can be used for this purpose. Closed loop control is used to regulate air temperature to result in optimized charge preheat chamber operation. In situations where alloy chemistry and corresponding solidus/liquidus temperatures require an air temperature higher than delivered by the turbine, an air dilution afterburner can be used. One such burner is a Model 4422 high pressure burner available from Fives North American Combustion, Inc. that can add a small quantity of heat to increase air temperature.

Potential benefits of this invention include:

1. Substantially higher heat flux based on bath surface area. Typical conventional burner heating operates at 125,000 BTU/hr-ft$^2$ bath area burner head to recover 31,200 BTU/hr-ft$^2$ in the melt. The invention heating methodology provides a net 337,000 BTU/hr to the same bath area. The result is more efficient heating and reduced metal containment. Furthermore, the invention can be less than 25% of the size of a conventional stack melter making it comparatively small and portable.

2. A lower holding energy for metal contained in the second chamber.

3. A sub-surface/anaerobic heat transfer with no associated oxidation.

4. An ability to respond faster to changes in charge rates.

5. Since no burner is used in second chamber, melt surface is not superheated. That causes some vaporization of the melt with consequential melt loss and downstream fouling in the stack due to condensed metal vapor and oxides.

6. Refractory life should be improved due to lower metal line and above metal line wall temperature.

7. Melting costs should be reduced due to higher thermal efficiency and reduced holding volume. Based on $4.00/dth natural gas, the energy cost only for a conventional 5,000 lb/hr stack melter is about $0.0056/lb. By contrast, the invention will melt at about $0.0045/lb (See, the highlighted "Stack ITM" sections in the accompanying chart).

8. The invention has the capability of adjusting fossil fuel/electricity ratios based on energy costs. Such ratios can be manipulated based on energy cost differentials.

9. Various sources of electricity can be used with this invention. One embodiment combines the melter with a gas turbine powered generator with exhaust gas enthalpy recovered in the shaft. (Note, the "CoGen ITM" reference in the chart below.)

10. The invention is not dependent on externally applied electricity.

11. It is capable of producing electricity when not being used for melting.

12. It can also operate on lean (i.e., low BTU) and green (landfill gas) fuels with a front end gas conditioning train.

EXAMPLE

| CoGen ITM Operating Performance (356 alloy) | | | | | | | | | | | |
|---|---|---|---|---|---|---|---|---|---|---|---|
| Apogee Proprietary information | | | | | | | | | | | |
| Inputs | | Outputs | | | | | | | | | |
| | | | | Prime Mover | | | | | | | |
| Ambient Temp., ° F. | 70 | | | 250-C18 | 250-C20 | 250-C20B | 250-C20B | 250-C20B | T58-400 | T58-16 |
| Gas fuel LHV, BTU/t$^3$ | 1,020 | Air Mass Flow | b/sec @ HP | 2.40 | 2.85 | 3.04 | 3.06 | 3.06 | 13.2 | 17.0 |
| Dist fuel LHV, BTU/lb | 18,400 | Pressure Ratio | | 6.80 | 6.7 | 6.8 | 6.9 | 6.9 | 8.5 | 8.6 |
| Metal Deliv. Temp. (T), ° F. | 1,300 | Shaft Power | HP-maxcont. | 270 | 330 | 370 | 410 | 410 | 1350 | 1750 |
| Liquidus ($T_L$), ° F. | 1,135 | Open Cycle SFC | b/h r-HP | 0.710 | 0.665 | 0.656 | 0.630 | 0.630 | 0.620 | 0.550 |

-continued

| | | | | | | | | | | | |
|---|---|---|---|---|---|---|---|---|---|---|---|
| Solidus/eutectic ($T_e$), ° F. | 1,071 | | Turbine N2 (PT iT-T5) | ° F. | 1,400 | 1,400 | 1,400 | 1,450 | 1,450 | 1,480 | 1,480 |
| Fraction Eutectic @ $T_s$ (356 alloy) | 0.53 | | Combustion Preheat | ° F. | 0 | 0 | 0 | 0 | 300 | 0 | 0 |
| $H_m$ of Eutectic only, BTU/lb | 278 | | Total Energy In | BTU/hr | 3,527,280 | 4,037,880 | 4,466,048 | 4,752,720 | 4,030,952 | 15,400,800 | 17,710,000 |
| $H_m$ of Proeutectic α only, BTU/lb | 182 | | Compressor CDT (calculated) | ° F. | 531 | 527 | 531 | 536 | 536 | 598 | 602 |
| Maximum Charge Preheat Temp., ° F. | 1,071 | | Turbine EGT (calculated) | ° F. | 1,098 | 1,089 | 1,074 | 1,091 | 1,091 | 1,206 | 1,204 |
| Cp Air @ STP, BTU/lb- ° R | 0.24 | | Effective Alloy SME (theoretical) | BTU/lb | 553 | 553 | 553 | 553 | 553 | 553 | 553 |
| Cp/Cv (γ) | 1.40 | | Feed Gas @ IHV | cfm | 58 | 66 | 73 | 78 | 66 | 252 | 289 |
| Cp Al(s, l), BTU/lb- ° F. | 0.26 | | Net Power tol™ ($\eta_{gen}$ = 0.85) | kWe | 158 | 193 | 216 | 239 | 239 | 788 | 1,021 |
| Melt Loss, % | 2 | | Max I™ Melt Rate (power limited) | b/hr | 3,030 | 3,832 | 4,274 | 4,979 | 4,979 | 23,340 | 30,448 |
| N.G. Compression Power, % | 8 | | Exhaust Enthalpy (total available) | BTU/hr @ EGT | 2,132,312 | 2,510,399 | 2,636,054 | 2,698,550 | 2,698,550 | 12,952,887 | 16,655,419 |
| Compressor Efficiency, % | 95 | | Exhaust Enthalpy (total recovered) | BTU/hr | 864,630 | 1,093,487 | 1,219,589 | 1,420,640 | 1,420,640 | 6,659,237 | 8,687,319 |
| Power Turbine Efficiency, % | 91 | | Sys. EGT | ° F. | 681 | 645 | 609 | 553 | 553 | 622 | 612 |
| Regenerator Effectiveness, % | 70 | | ηThermal (overall melter) | % | 39.8% | 43.4% | 43.8% | 47.1% | 55.5% | 60.7% | 68.7% |
| Melter Holding Power, kW | 35 | | Actual Alloy SME | BTU/lb | 1,391 | 1,275 | 1,262 | 1,175 | 996 | 911 | 804 |
| Gas Cost, $/dth | $ 4.00 | | CoGenI™ Melting Energy Cost | $/lb | $ 0.0047 | $ 0.0042 | $ 0.0042 | $ 0.0038 | $ 0.0082 | $ 0.0026 | $ 0.0023 |
| Electic Cost, $/kW-h | $ 0.070 | | Stack I™ Melting Energy Cost | $/lb | $ 0.0048 | $ 0.0047 | $ 0.0047 | $ 0.0045 | $ 0.0045 | $ 0.0035 | $ 0.0035 |
| | | | Open Cycle Electricity Generation | $/kW-h | $ 0.0896 | $ 0.0839 | $ 0.0828 | $ 0.0795 | $ 0.0674 | $ 0.0782 | $ 0.0694 |

This invention will develop a multi fuel portable/deployable CoGen aluminum melting system capable of using natural gas or electricity as source energy. The following leading particulars apply for a complete system based on melting an Al-7% Si hypoeutectic alloy delivered at 1300° F.:

- 49% total cycle efficiency with natural gas feed only at 4,500 lb/hr throughput
- 97% thermal efficiency with external electricity only (no NG) at 2,000 lb/hr throughput
- Instant start-up from idle mode
- Requires 25 kW to hold—supplied by an NG reciprocating generator
- Exceptional metal quality
- Distillate fuel option
- 250 kVA generating capacity (not concurrent with melting)
- Total empty package weight less than 28,000 pounds
- Internet capable remote monitoring and control
- Low thermal signature
- System footprint: 12 ft.×8 ft. (without charging device)
- Multiple melter feed/charge options
- Uses cost effective "recycled" (possibly even Army surplus) aero-derivative turbines A completely integrated/packaged cogeneration "CoGen ITM" melting system will consist of a compact Isothermal Melter (ITM®), an integral "REVROT" metal treatment system, a generator, a (continuous) aero-derivative gas turbine prime mover, a feed gas compressor (booster), a melter charge preheat/recuperation system and a control system.

The CoGen ITM can be close coupled to a variety of solidification processes including a constant metal level, weir based metal filtration and distribution system, a conventional shape casting, an advanced shape casting, an atomization unit and/or a roll casting/melt spinning unit. Metal flow there through should be displacement-gravity driven.

While this invention may be conceptually similar to conventional cogeneration in that a top cycle waste energy is recuperated from the prime mover exhaust stream, it differs substantially from same in that the bottom cycle in the present process is a heat exchange between the turbine exhaust and incoming aluminum charge. No moving parts are used in that heat transfer process. Thermal and kinetic energy from the gas turbine prime mover exhaust can be recovered by the ITM® charge preheat system to both dry and preheat melter feed.

Also, with respect to turbine exhaust recuperation, it should be noted that the use of same results in a lower temperature than traditional "stack" melters thereby leading to less oxidation of a metal (aluminum) charge. Because the recuperator media (melter charge) is renewable, it is less likely to "foul". And with the high kinetic energy/velocity of turbine exhaust gas, heat transfer to the melter charge is improved.

A fluidized bed may be used to enhance heat transfer in situations where the melter feed consists of light flowable scrap or machining chips. That bed will be supported by the high exhaust mass flow of approximately 3 lb/sec. An exhaust venturi/air amplifier may be used to facilitate chip feed by suction lift.

The present invention exploits the inherent low emissions characteristics of gas turbine prime movers. It is projected to produce approximately 0.03 g $NO_x$, 0.015 g CO, and 50 g $CO_2$ per lb Al melted when operating on a natural gas fuel source. These values compare very favorably with all other forms of aluminum melting and electric power generation.

The ITM® process is intrinsically suited for a deployable cogeneration aluminum melting process. Conventional gas and glow bar/radiant electric melters in the same throughput class, will contain approximately 45,000 lbs of static metal, weigh in excess of 100,000 lb (empty) and are typically integrated into the foundation of a building's structure. In excess of 1.8 MM BTU/hr would be required at idle. By comparison, an ITM integrated into this package will contain less than 9,000 lbs static metal, weigh approximately 20,000 lbs. and require only 150,000 BTU/hr when not melting.

As a "continuous" process, the ITM® component of this invention is capable of recuperation while electric melters (such as coreless induction furnaces) are not.

Figure 11:
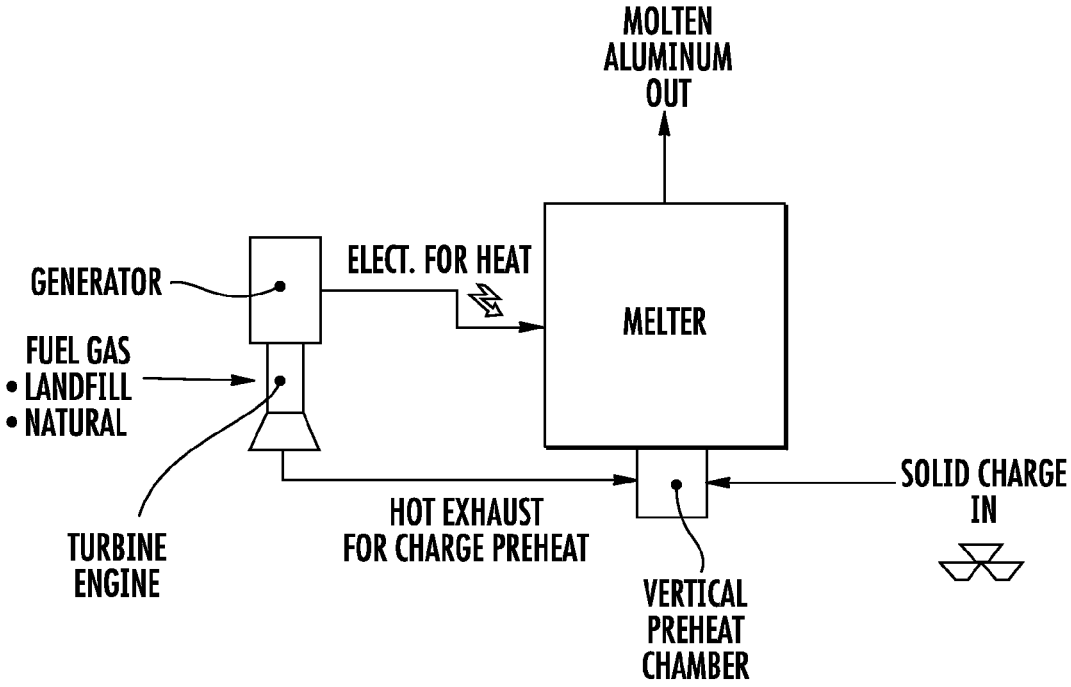
FIG. 11 is a schematic representation of one preferred arrangement for adding solid metal charge and extracting molten metal using a vertical preheat chamber.

Schematically, FIG. 11 schematically shows one preferred CoGen arrangement for adding solid metal charge to the system and extracting molten metal (aluminum) therefrom. That system employs a vertical preheat chamber.

Figure 12:
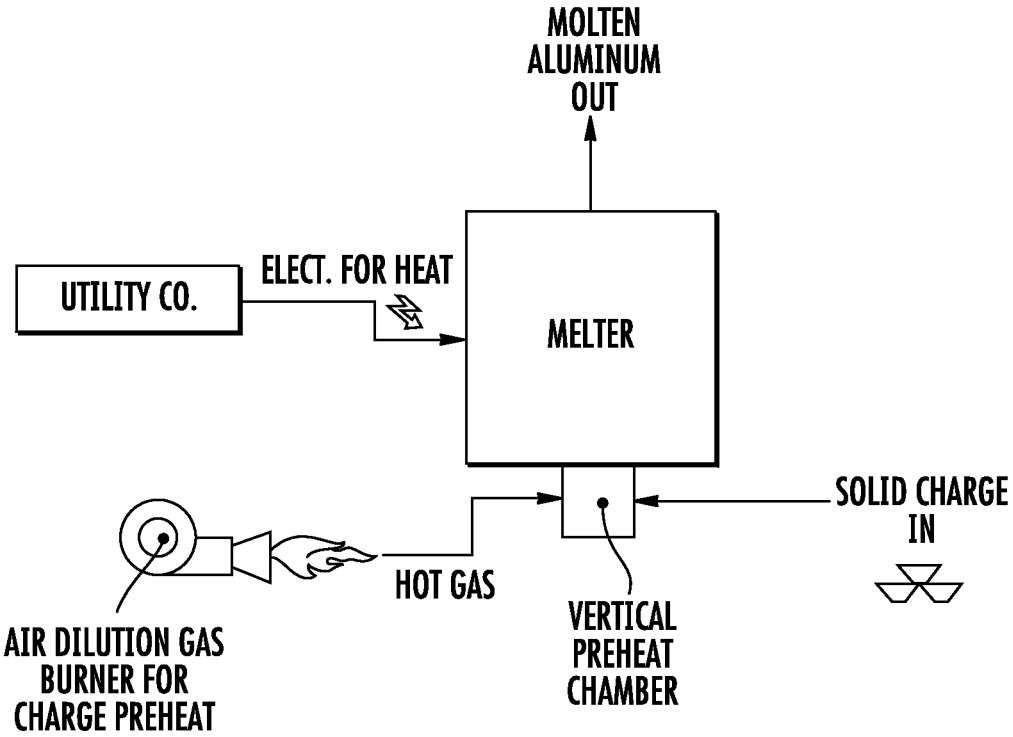
FIG. 12 is a schematic representation of an alternative embodiment that uses an air dilution gas burner for charge preheating.
Figure 13:
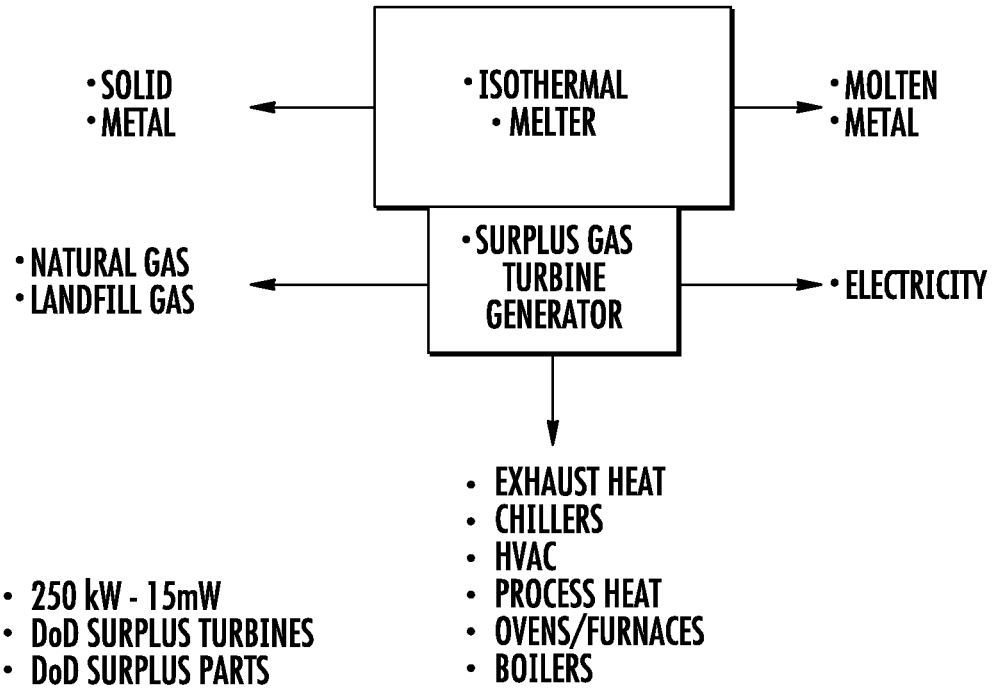
FIG. 13 is a flowchart depicting an ITM® melter situated to receive solid metal for melting and a gas turbine generator used in conjunction therewith to generate exhaust heat and/or electricity.

FIG. 12 shows an alternative CoGen concept with an air dilution gas burner for preheating the charge. FIG. 13 simplifies that flowchart moreso with an ITM® melter duly situated to receive solid metal for melting, and a gas turbine generator used in conjunction with same taking in various gases to generate Exhaust Heat and/or Electricity therefrom.

Figure 14:
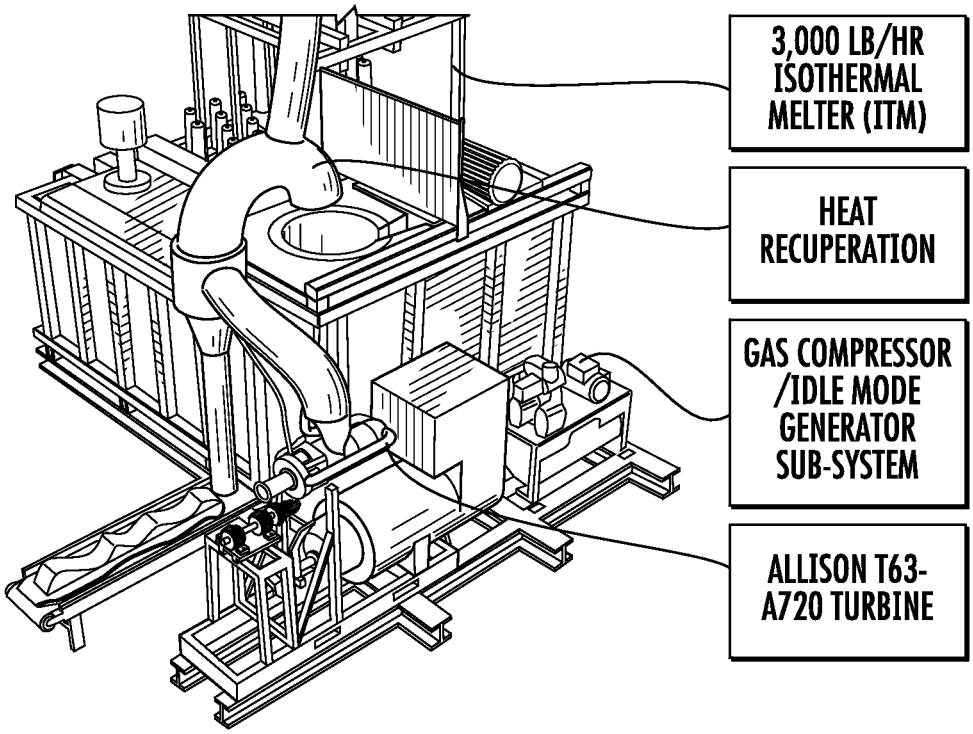
FIG. 14 is a perspective view of one embodiment using a gas turbine.
Figure 15:
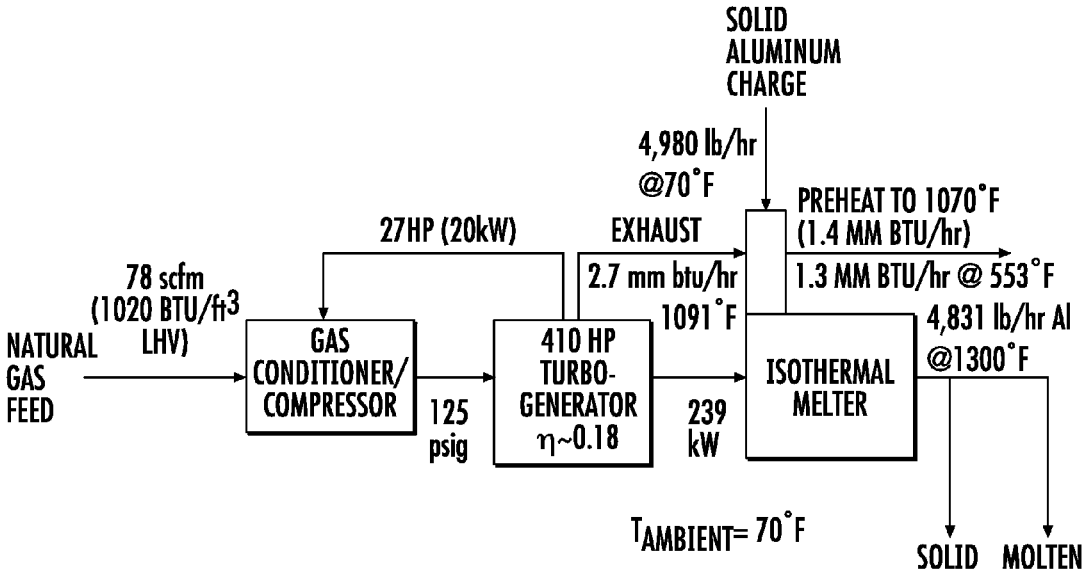
FIG. 15 is a flowchart depicting a mass/energy balance for one example of melter according to this invention.

One embodiment that uses a gas turbine is shown in a perspective view in accompanying FIG. 14. A mass/energy balance for one example of that melter is shown in accompanying FIG. 15. For said melter example: overall cycle efficiency is 49.8%; 1.3 MM BTU/hr @ 550° F. is available; it uses military surplus aero-derivative turbines; it has a conservative maximum continuous (410 HP) power rating; and molten aluminum can be shipped ($2.7\times10^6$ BTU energy content).

Figure 16:
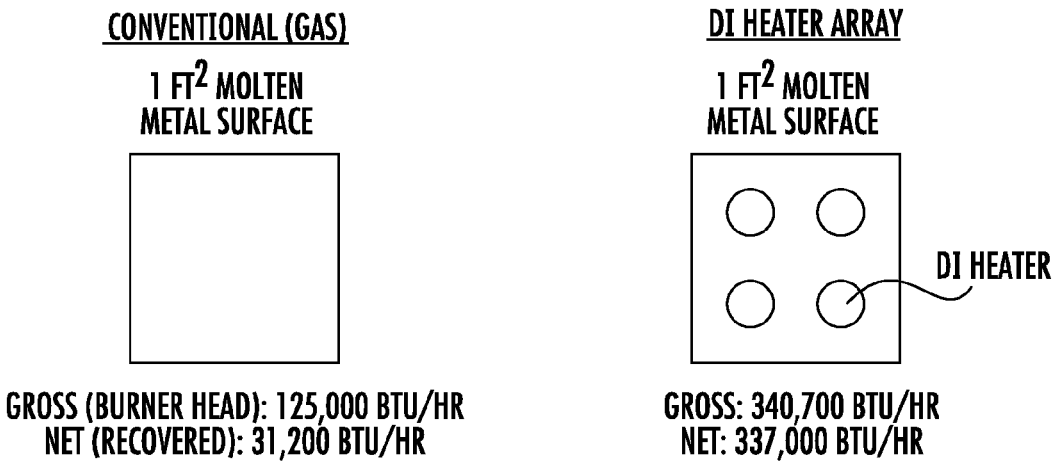
FIG. 16 is a side-by-side comparison of the difference in heat flux with conventional gas versus a DI array.

In FIG. 16, there is shown a side-by-side comparison of the difference in heat flux with conventional gas versus a DI Array. It evidences how much higher heating density can be with ITM® (or its variants) as compared to a conventional burner system.

Figure 17:
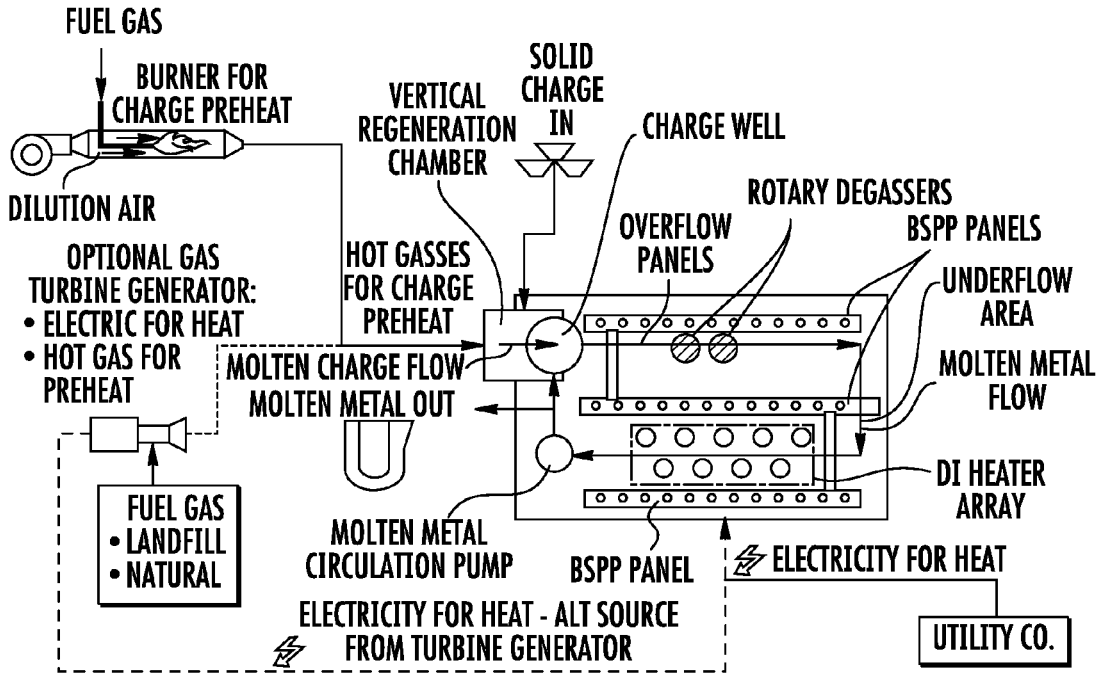
Figure 18:
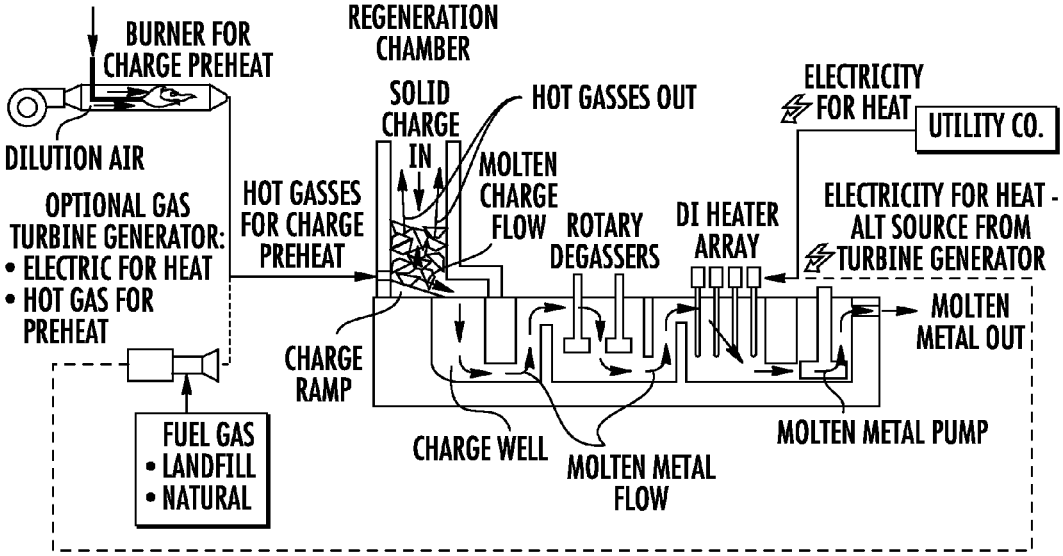
FIG. 18 is a linear, semi-cross sectional view of the embodiment of FIG. 14.

FIG. 17 shows an essentially top view perspective of one embodiment for incorporating ITM® in a stack-like arrangement with FIG. 18 showing more of a linear, semi-cross sectional view.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention.

What is claimed is:

1. An energy efficient metal melter wherein a portion of melting energy is supplied by exhaust from a gas turbine engine for heating a melter charge to a temperature where the melter charge can no longer maintain its shape and a portion of melting energy is supplied by an electrical process for adding remaining transformational and sensible heat.

2. The energy efficient metal melter of claim 1 wherein the electrical process is capable of operating at a heat flux above about 15 w/in$^2$.

3. The energy efficient metal melter of claim 2 wherein the electrical process is capable of operating at a heat flux above about 30 w/in$^2$.

4. The energy efficient metal melter of claim 3 wherein the electrical process is capable of operating at a heat flux above about 65 w/in$^2$.

5. The energy efficient metal melter of claim 4 wherein the electrical process is capable of operating at a heat flux above about 90 w/in$^2$.

6. The energy efficient metal melter of claim 5 wherein the electrical process is capable of operating at a heat flux above about 100 w/in$^2$.

7. The energy efficient metal melter of claim 1 wherein after the charge can no longer maintain shape, a portion of the energy is supplied by a process based on heat conduction.

8. The energy efficient metal melter of claim 7 wherein said portions of combustion process energy and said electrical heating energy can be varied during operation.

9. The energy efficient metal melter of claim 8 wherein said combustion process and said electrical heating energies are supplied at a ratio of less than about 10:1.

10. The energy efficient metal melter of claim 9 wherein said combustion process and said electrical heating energies are supplied at a ratio between about 0.5:1 and 7:1.

11. The energy efficient metal melter of claim 10 wherein said combustion process and said electrical heating energies are supplied at a ratio between about 0.75:1 and 3.5:1.

* * * * *